United States Patent [19]

Daniel

[11] 4,304,190

[45] Dec. 8, 1981

[54] FERRY BOAT

[76] Inventor: Nathan I. Daniel, 948 Kailiu Pl., Honolulu, Hi. 96825

[21] Appl. No.: 913,574

[22] Filed: Jun. 5, 1978

[51] Int. Cl.[3] ..... B63B 35/54; B63B 39/00

[52] U.S. Cl. ..... 114/258; 114/60; 114/61; 114/123

[58] Field of Search ..... 114/61, 70, 39, 123, 114/283, 288, 264, 274, 258, 261, 60, 292, 259; 115/37

[56] References Cited

U.S. PATENT DOCUMENTS

| | | | |
|---|---|---|---|
| 1,013,982 | 1/1912 | Benyo | 115/37 |
| 1,021,294 | 3/1912 | Antoniades | 114/258 X |
| 1,710,625 | 4/1929 | Kapigian | 114/123 |
| 1,853,125 | 4/1932 | Hitt | 114/61 |
| 2,139,303 | 12/1938 | Greg | 114/283 |
| 2,159,410 | 5/1939 | Turkavich | 114/283 |
| 3,150,628 | 9/1964 | Brinkmann et al. | 114/123 |
| 3,585,955 | 6/1971 | Cella | 114/123 |
| 3,988,994 | 11/1976 | Nitzki | 114/61 |
| 3,990,380 | 11/1976 | Regan | 114/61 |
| 3,996,871 | 12/1976 | Boismard | 114/61 X |

FOREIGN PATENT DOCUMENTS

| | | | |
|---|---|---|---|
| 16161 | of 1884 | United Kingdom | 114/61 |
| 631381 | 11/1978 | U.S.S.R. | 114/61 |

*Primary Examiner*—Galen L. Barefoot
*Attorney, Agent, or Firm*—Fleit & Jacobson

[57] ABSTRACT

A boat is disclosed which is particularly adapted for operation in rough seas. It includes a closed support hull, open support structure extending upwardly from the support hull, a deck mounted above the support hull and on the open support structure, a closed stabilizer hull laterally spaced from the support hull, and open connecting structure between the stabilizer hull and the support hull thereby permitting tall waves to pass over the hulls and through the support structures to provide a vessel for transporting motor vehicles, passengers and the like through open, rough seas.

5 Claims, 4 Drawing Figures

FERRY BOAT

This invention is in the field of boats and is specifically directed to a ferry boat which is capable of operating in rough seas.

Prior known boats have generally been of the construction which includes an open hull and high closed sides on the vessel to deflect waves and provide sufficient structural rigidity to withstand the loads imposed by the waves in those areas through which the boat must operate. Where rough seas are anticipated, it has been necessary to build very heavy and therefore expensive vessels to provide for the necessary safety and comfort for the occupants. It is noted that vessels which are designed to operate on inland waters or on sheltered bays cannot be operated in the open ocean because they are incapable of withstanding the higher waves of the ocean. In the areas of the world that are lacking in adequate ferry service, the previous boats have been unable to negotiate rough seas while maintaining a stable passenger deck for transporting of motor vehicles and passengers. As in the Hawaiian Islands, inter-island passenger service has been accomplished by aircraft. Personal motor vehicles can only be shipped separately by sea-going tug and barge freight lines.

Therefore, it is the object of the present invention to provide a new and improved boat.

BACKGROUND OF THE INVENTION

Another object of the present invention is to provide a boat which is capable of negotiating through rough seas.

A still further object of the present invention is to provide a boat which is capable of operating without the use of a rudder.

SUMMARY OF THE INVENTION

Obtainment of the objects of this invention is enabled through the provision of a boat having a closed support hull and a closed stabilizer hull laterally spaced from the support hull and connected to the support hull by open support structure. A deck for transporting motor vehicles, passengers or the like is supported above the closed support hull on open truss members thereby providing a configuration through which waves may pass over portions of the two hulls and through the open support structure without creating heavy loading on the various members. The truss configuration provides rigidity to the support hull thereby permitting it to bridge between wave crests without destroying the structural integrity of the boat. Propulsion is provided by three conventional propeller drive units with the center unit positioned to drive the boat straight ahead when the other drive units are not operating. A closed passenger compartment may be provided on the deck for protecting the passengers from the weather.

A better understanding of the manner in which the preferred embodiment of the invention achieves the objects of the invention will be enabled when the following written description is read in conjunction with the appended drawings.

DESCRIPTION OF THE PREFERRED EMBODIMENT

Figure 1:
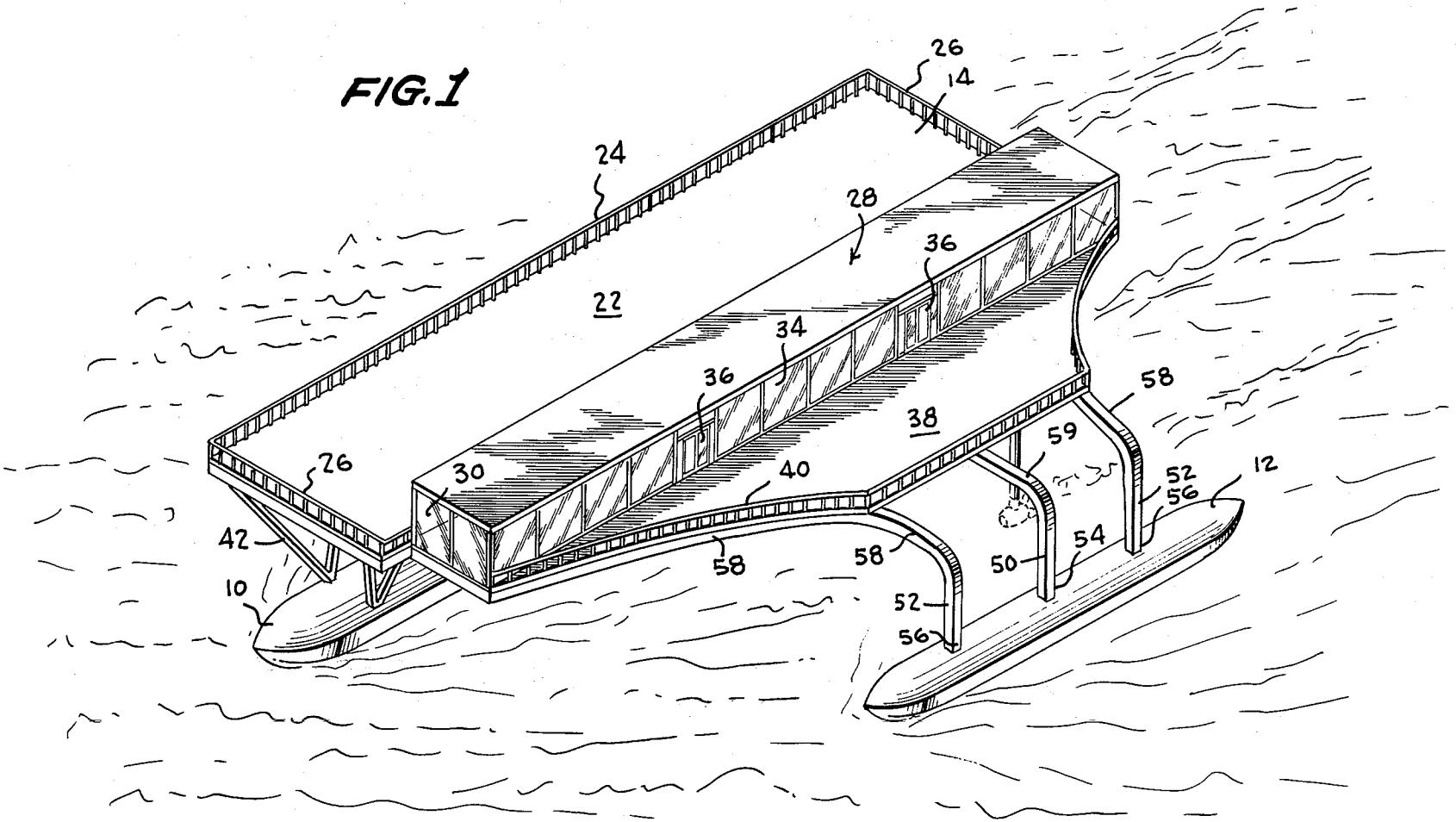
FIG. 1 is a perspective view of the preferred embodiment.
Figure 2:
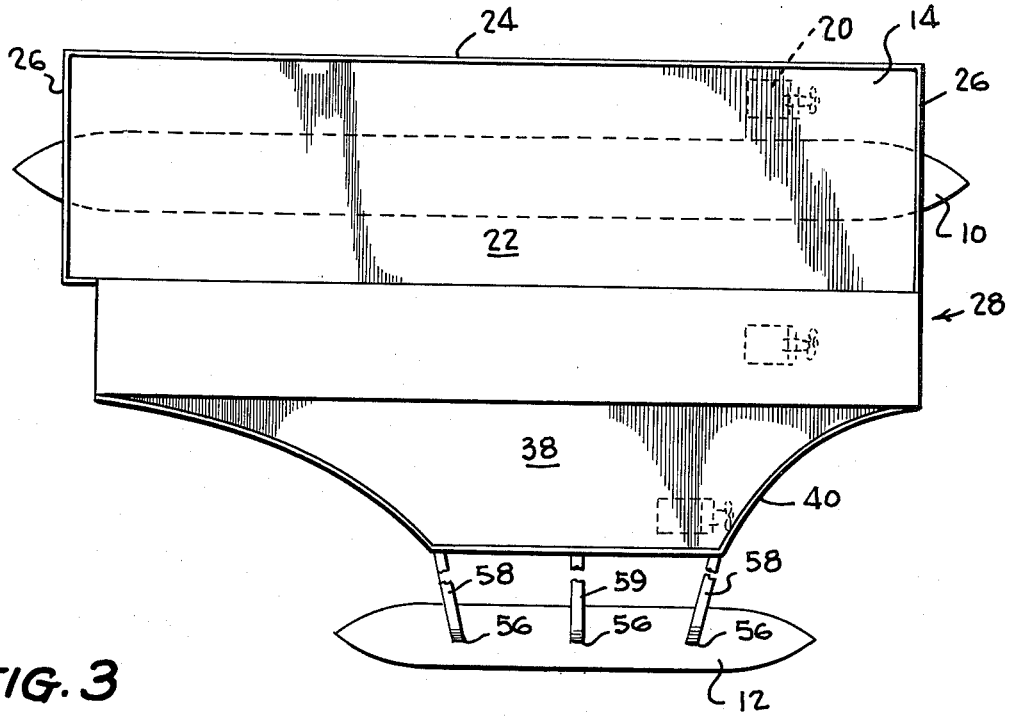
FIG. 2 is a top elevational view of the preferred embodiment.
Figure 3:
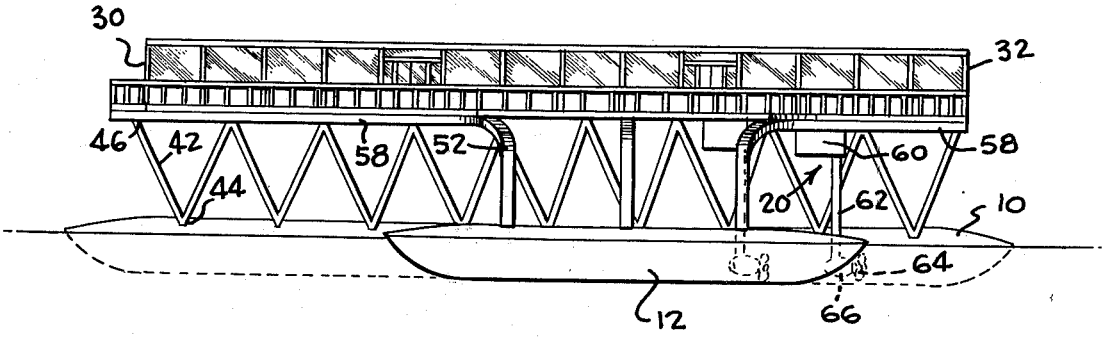
FIG. 3 is a side elevational view of the preferred embodiment.

Attention is initially invited to the various figures of the drawings illustrating the preferred embodiment of the invention which includes a main support hull 10, a stabilizer hull 12, a deck 14, truss support structure 16, connecting structure 18, and propulsion units 20.

The closed support hull 10 is of conventional construction such as steel, aluminum or fiberglass, and is completely enclosed to permit submersion of any portion of the hull without having any water enter the hull. This closed configuration permits waves to roll over the hull without flooding of the hull. Compartments may be formed within the hull to restrict any flooding resulting from collisions with floating objects or the like. As can be seen from the various figures, the support hull 10 is of symmetrical configuration to permit operation of the boat in either direction, fore or aft. The support hull may be of any desired configuration and can be several hundred feet in length depending upon the carrying capacity desired.

Laterally spaced from the support hull 10 is the stabilizer hull 12 which is also of closed construction. The stabilizer hull 12 is very similar in configuration and construction to the support hull 10 although it is of much smaller size as can be seen from the various figures. The primary function of the stabilizer hull 12 is to maintain the deck 14 in a generally horizontal position even in rough seas. Being spaced far apart from the support hull 10, the stabilizer hull 12 greatly reduces the rolling motion of the support hull and the deck. Like the support hull 10, the stabilizer hull 12 is relatively long which permits the stabilizer hull to bridge across the crests of waves.

In the embodiment shown in the figures, the deck 14 includes a vehicle area 22 for transporting motor vehicles. This deck, in the embodiment shown, would carry eleven rows of automobiles with four automobiles in each row, thereby providing a carrying capacity of forty-four automobiles. A safety guard rail 24 extends around the outer edge of the deck 22 to prevent accidental loss of vehicles or passengers. The opposite ends 26 of the guard rail are removable to permit driving the motor vehicles onto and off the deck 14 at either end of the boat. Conventional means for fastening the motor vehicles to the deck could be provided.

A passenger compartment 28 having glass end walls 30 and 32 and a glass side wall 34 with doors 36 provides protection for the passengers who do not desire to spend their time on a passenger area 38 adjacent the compartment. Appropriate restrooms, lounges, restaurants and the like are provided within the passenger compartment 28 for the comfort of the passengers. The passenger deck area 38 is surrounded by a guard rail 40 similar to guard rail 24 to provide protection for the passengers on the deck.

Deck 14 may be formed of conventional truss members as required to achieve the desired structural strength and rigidity.

Extending upwardly and outwardly from the support hull 10 are truss members 42 which are connected at their lower ends 44 to the support hull 10 and at their upper ends 46 to the deck 14. The truss members 42 are positioned to create an open triangulated truss configuration with the support hull 10 forming the lower chords and the deck 14 forming the upper chords with the truss members 42 as the connecting web. This configuration produces a very rigid structure which is capable of bridging across the crests of adjacent waves to reduce the pitching, yawing and rolling of the deck 14 when the boat is navigating rough seas. This configuration permits the waves to wash through under the deck while experiencing very little resistance in the open support structure. Truss members 42 may be encased in streamlined housings to further reduce resistance.

The stabilizer hull 12 is attached to the support hull 10 by the open connecting structure 18 including a center connecting leg 50 and end connecting legs 52 attached at the lower ends 54 and 56 to the stabilizer hull 10. Upper portions 58 and 59 of the connecting legs 52 and 50 form an integral portion of the deck 14 to transmit the upward thrust caused by the buoyancy of stabilizer hull 12 through the deck and support structure 16 to the support hull 10.

Legs 50 and 52 may be formed of telescopic construction with interior hydraulic cylinders and appropriate control circuitry to position the stabilizer hull at a desired distance from the deck 14 as required to maintain the deck in a level orientation for the various loading conditions of motor vehicles and passengers. Additionally, the upper portions 58 and 59 of the connecting legs 52 and 50 may be similarly formed of telescopic construction to permit retraction of the stabilizer hull 12 toward the support hull 10 thereby permitting the boat to enter a narrow harbor.

Figure 4:
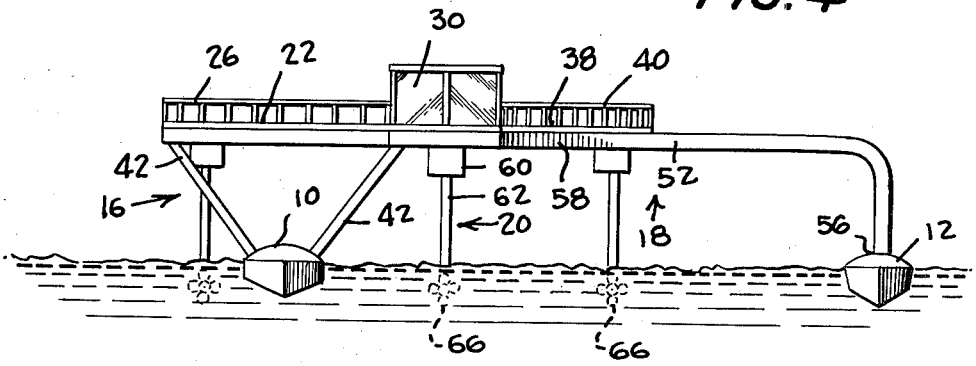
FIG. 4 is a front elevational view of the preferred embodiment.

As best shown in FIG. 4, propulsion for the boat is provided by conventional propeller units having an engine housing 60 enclosing therein a marine diesel engine or the like. Extending downwardly from the engine housing 60 is a drive shaft housing 62 in which a conventional drive shaft driven by the engine is rotated. At the lower end of the drive shaft, bevel gears transmit power to a conventional propeller 64 extending rearwardly from a propeller housing 66 mounted at the lower end of the drive shaft housing 62.

As can be seen from FIG. 4, there are three drive units 20 and the center drive unit is positioned at the location which causes the boat to travel in a straight line on a calm sea. This configuration permits propulsion of the boat by the single center propeller drive unit with operation of the outside drive units providing any desired additional thrust. By controlling the speed of the outer drive units, the boat can be turned to the right or left depending on which unit is being operated. In case of failure of one drive unit, the remaining two could satisfactorily perform all necessary functions. Conventional controls can be provided for operation of the propulsion units in a conventional manner. Additionally, conventional rudders can be incorporated in the support hull 10 and/or stabilizer hull 12 if desired. Rudders would be necessary if a single propulsion unit 20 is incorporated in the design.

A boat according to the present invention provides a large capacity ferry boat or the like which is capable of navigating extremely rough seas since the hulls 10 and 12 are of elongated configuration and may be sized to bridge between the crests of adjacent waves while maintaining adequate structural strength and rigidity to withstand the loads imposed in such situations. The open configuration of the truss support structure 16 and connecting structure 18 permits waves to pass under the deck 14 while imposing minimum loads on the boat.

From the foregoing detailed description, it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim:

1. A watercraft comprising:

an elongated closed support hull;

a deck positioned immediately above said elongated closed support hull with the load from said deck being distributed so that said support hull provides substantially all of the support for said deck;

an open truss framework extending between said elongated closed support hull and said deck for providing support for said deck and longitudinal rigidity for said elongated closed support hull, said deck being spaced from and located above said support hull;

stabilizer means consisting of a closed stabilizer hull of substantially less length and displacement than said elongated closed support hull, said stabilizer hull being located on one side of said support hull in an asymmetrical arrangement;

open connecting structure means extending between said deck and said closed stabilizer hull for maintaining said closed stabilizer hull in a laterally spaced position a sufficient distance from said elongated closed support hull to greatly reduce rolling motion of said elongated closed support hull and to maintain said deck in a generally horizontal position; and drive means operatively connected to said elongated closed support hull for contacting the water and providing a driving thrust to the watercraft with the drive means being controllable to permit various modes of operation, including forward, reverse and steering.

2. A watercraft according to claim 1, wherein said drive means comprises multiple drive means operatively connected to said elongated closed support hull for contacting the water and providing driving thrust to the ferryboat with the drive means being differentially controllable to permit various modes of operation, including forward, reverse, steering, and turning in place, thereby permitting operation of the boat with or without a rudder.

3. A watercraft according to claim 2 wherein said open truss framework includes open trusses fixed at a lower end thereof to said elongated closed support hull and at an upper end thereof to said deck with said trusses flairingly extending outwardly and upwardly from opposite sides of said elongated closed support hull.

4. A watercraft according to claim 1 wherein said open truss framework comprises a first group of linear frame members canted outwardly and upwardly from one side of said elongated closed support hull and a second group of linear frame members canted outwardly and upwardly from an opposite side of said elongated closed support hull, said linear frame members being connected to a next-adjacent linear frame member at each end adjacent their respective connection to the elongated closed support hull and side deck so that adjacent linear frame members cooperate with the elongated closed support hull and the deck to define triangular truss structure.

5. The invention of claim 4, wherein said drive means comprises multiple drive means operatively connected to said elongated closed support hull for contacting the water and providing a driving thrust to the watercraft with the drive means being differentially controllable to permit various modes of operation, including forward, reverse, steering, and turning in place, thereby permitting operation of the boat with or without a rudder.

* * * * *